US006803841B2

(12) United States Patent
Saitoh et al.

(10) Patent No.: US 6,803,841 B2
(45) Date of Patent: Oct. 12, 2004

(54) DIELECTRIC LINE, HAVING A DIELECTRIC STRIP FITTED IN A GROOVE BETWEEN TWO CONTACTING CONDUCTORS

(75) Inventors: Atsushi Saitoh, Muko (JP); Hidemasa Iwami, Omihachiman (JP); Shinichi Tamura, Moriyama (JP); Hideki Imura, Sagamihara (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/294,758

(22) Filed: Nov. 15, 2002

(65) Prior Publication Data

US 2003/0137371 A1 Jul. 24, 2003

(30) Foreign Application Priority Data

Nov. 16, 2001 (JP) ..... 2001-351422
Oct. 21, 2002 (JP) ..... 2002-306164

(51) Int. Cl.[7] ..... H01P 3/16
(52) U.S. Cl. ..... 333/239; 333/248

(58) Field of Search ..... 333/239, 248

(56) References Cited

U.S. PATENT DOCUMENTS 5,861,782 A * 1/1999 Saitoh ..... 333/239
5,982,255 A * 11/1999 Tanizaki et al. ..... 333/239

FOREIGN PATENT DOCUMENTS

JP 09-102706 4/1997
JP 2000-134008 5/2000

* cited by examiner

*Primary Examiner*—Benny Lee
(74) *Attorney, Agent, or Firm*—Dickstein, Shapiro, Morin & Oshinsky, L.L.P.

(57) ABSTRACT

A dielectric strip is located in a space formed by facing grooves in two conductors. A corner of the groove bottom surface Gb has a sectionally substantial arc form. A groove side surface Gs is tapered such that a gap can be provided between the groove side surface Gs and the side surface of the dielectric strip.

10 Claims, 8 Drawing Sheets

DIELECTRIC LINE, HAVING A DIELECTRIC STRIP FITTED IN A GROOVE BETWEEN TWO CONTACTING CONDUCTORS

BACKGROUND OF THE INVENTION

1. Field of the Invention

The present invention relates to a dielectric line used in an extremely high frequency (EHF) band and/or in a microwave band, a high frequency circuit and a high frequency circuit apparatus.

2. Description of the Related Art

Conventionally, a waveguide, a dielectric line, a flat circuit type transmission path and so on are used as a transmission path for signals in a microwave band and/or in an EHF band. These transmission paths are used properly in accordance with a circuit construction, a characteristic required for a given circuit, a purpose of a given circuit apparatus and so on.

Japanese Unexamined Patent Application Publication No. 2000-134008 discloses components of a dielectric-installed waveguide.

In general, a design parameter for constructing a high frequency module having a rectangular waveguide as a transmission path only depends on horizontal and vertical dimensions of a section of a waveguide. Therefore, the design has low flexibility.

A specific dielectric constant of a dielectric installed as a waveguide may be used as a design parameter among components of a dielectric-installed waveguide of conventional dielectric lines. Thus, a higher design flexibility can be obtained compared to that of a hollow waveguide.

A conventionally designed dielectric-installed waveguide has a groove facing against two upper and lower conductors. The two upper and lower conductors are aligned such that a sectionally rectangular dielectric strip can fit in the groove.

However, the sectionally rectangular groove cannot easily be formed on a metal plate. The variation in characteristic due to the precision of the dimensions of the groove and the dielectric strip cannot be reduced. In addition, since line expansion coefficients differ greatly between a conductive plate and the dielectric strip, a characteristic may change due to the deformation of the dielectric strip where there is a change in environmental temperature. When chipping or cracking occurs in the dielectric strip, the characteristic is also changed.

The object of the present invention is to provide a dielectric line, which can be easily manufactured and suppresses a variation in electric characteristics and a change in characteristics due to a change in temperature, as well as a high frequency circuit and a high frequency circuit apparatus having the dielectric line.

SUMMARY OF THE INVENTION

According to one aspect of the invention, there is provided a dielectric line including two conductors and a dielectric strip provided between the two conductors. In this case, the two conductors have respective grooves between which the dielectric strip fits. The bottom corner of the groove has a cross-sectional radius form. The side surface of the groove tapers such that the width of the groove can increase as a distance from the bottom surface increases. A gap is provided between the side surface of the groove and the side surface of the dielectric strip.

A gap may be provided between the bottom surface of the groove and a surface of the dielectric strip facing against the bottom surface of the groove.

Preferably, an opening edge of the groove has a cross-sectional radius form or a cross-sectional chamfered form.

The two conductors may be symmetric with respect to a plane.

A corner of the dielectric strip may have a cross-sectional radius form.

Preferably, the width of the groove is equal to or less than ½ of a wavelength in an operating frequency band or below. Twice the value of the groove depth may be equal to or greater than ½ of the wavelength in the operating frequency band, and may be equal to or less than the wavelength.

The two conductors may have different rigidity.

Preferably, the thickness of a connection portion of the two conductors is different from each other such that the two conductors can have the different rigidity.

According to another aspect of the present invention, there is provided a high frequency circuit comprising a dielectric line having one of the above-described constructions as a signal transmission line.

According to another aspect of the present invention, there is provided a high frequency circuit apparatus including a high frequency circuit in a portion for processing sent signals or received signals.

According to an aspect of the present invention, a conductor can be manufactured easily by die-cast molding. The dielectric strip can be fitted in the groove easily, which improves the assembly characteristic. The dielectric strip can be positioned easily at the center of a space formed between the grooves of the two conductors. The relative expansion of the dielectric strip due to the temperature increase can be absorbed by the gap between the side surface of the dielectric strip and the side surface of the groove. Therefore, stable electric characteristics can be maintained.

According to an aspect of the present invention, cracking, chipping or deformation of the dielectric strip can be prevented. Thus, the change in characteristic can be sufficiently avoided.

According to an aspect of the present invention, when a conductor is manufactured by die-cast molding, the lifespan of the die can be increased. The current concentration in the edge portion of the groove opening edge of the two conductors can be alleviated. Thus, the transmission loss can be suppressed.

According to an aspect of the present invention, symmetrical characteristic of stress to a space formed by facing grooves can be maintained when two conductors have contact. Thus, an entirely stable rigid structure can be obtained.

According to an aspect of the present invention, the bottom surface of the groove and the upper and lower surfaces of the dielectric strip have surface contact. Therefore, no unnecessary spaces occur, and the stable electric characteristic can be obtained. The dielectric strip can be inserted to the grooves of the conductors, which improves the assembly characteristic. The ease of the insertion of the dielectric strip to the grooves and the sensitivity of the wobble due to the tolerance of the width dimension of the dielectric strip can be alleviated.

According to an aspect of the present invention, the single mode transmission is possible in the used frequency band. As a result, no losses relating to mode changes occur, and lower transmission loss can be obtained.

According to an aspect of the present invention, a less rigid conductor bends in relation to a more rigid conductor. Thus, the tightness of the two conductors is increased, and the transmission loss can be suppressed.

According to an aspect of the present invention, the two conductors of the same material can have different rigidity. The increase in total manufacturing costs does not occur.

According to an aspect of the present invention, an apparatus having fewer transmission losses and higher power efficiency can be obtained. The decrease in the signal to noise ratio can be suppressed. When a radar is used, the detectable distance can be increased. When a communication apparatus is used, the data transmission error rate can be reduced.

DESCRIPTION OF THE PREFERRED EMBODIMENTS

Figure 1:
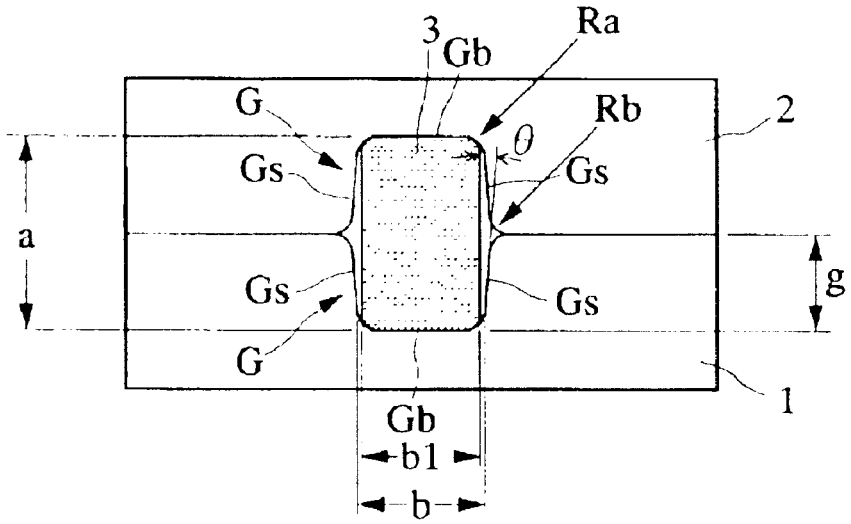
FIG. 1 is a section diagram of a main part of a dielectric line according to a first embodiment.

FIG. 1 shows a construction of a dielectric line according to a first embodiment. FIG. 1 is a section diagram in a plane perpendicular to a signal transmitting direction. FIG. 1 includes conductors 1 and 2 formed from metal plates. In this example, the two metal plates have sectionally rectangular grooves G on the surfaces facing against each other. A dielectric strip 3 is provided in a gap formed by the grooves G when the conductors 1 and 2 face against each other. Hatching indicating sections is omitted for the conductors 1 and 2. The same is true in following diagrams.

A corner Ra of a bottom surface Gb of the groove G has a cross-sectional radius shape, which is so-called "R-processed". A side surface Gs of the groove G is tapered such that the width can be increased as the distance from the bottom surface Gb increases. Thus, a gap is provided between the side surface Gs of the groove G and a side surface of the dielectric strip 3.

An opening edge Rb of two grooves has a cross-sectional radius shape, which is so-called "R-processed".

Fluorine resin whose specific dielectric constant $\in r$ is about 2.0 is preferably used as the dielectric strip 3 and a signal in a band of 76 GHz, for example, is transmitted in the construction shown in FIG. 1. In this case, the dimensions of the shown parts are:

Height a of the dielectric strip 3: 1.8

Width b1 of the dielectric strip 3: 1.1

Width b of the groove bottom surface Gb: 1.2

Depth g of the groove G: 0.9

Taper angle θ of the groove side surface Gs: 2°

Roundness Ra of the groove bottom corner: 0.3

Roundness Rb of the groove opening edge: 0.3 where the unit of the dimensions is mm. The unit of roundness "Ra" and "Rb" is a radius of curvature.

In FIG. 1, a wavelength λ in the dielectric strip 3 in an operating frequency is 2.8 [mm]. The groove width b is ½ of λ or below. Twice the value of the groove depth, 2 g is between λ/2 and λ.

The construction allows the single-mode transmission in the used frequency band. In other words, the transmission uses only the rectangular TE 10 mode, and all of the other modes are blocked. Therefore, even when, for example, a groove position on the conductor is displaced, the mode is not converted to another transmission mode. As a result, the loss involved in a mode change does not occur, a low transmission rate can be maintained.

The conductors 1 and 2 are preferably formed by Zn or Al (aluminum) die-cast molding. A metal film having a higher conductivity, such as Ag or Au, is preferably placed on the surface.

In this way, by having the round corner of the groove bottom surface and the round opening edge of the groove and by having the groove side surface tapered outward, the molding of the conductors can become easier. Thus, the manufacturing cost can be reduced.

The width b1 of the dielectric strip 3 and the width b of the groove bottom surface Gb are preferably substantially equal so that the dielectric strip 3 can be placed more precisely at the center of the space between the facing grooves. In other words, the two conductors 1 and 2 and the dielectric strip 3 can be positioned properly with respect to each other.

Since a gap occurs between the groove side surface Gs and the side surface of the dielectric strip 3, the distortion involved in the temperature change due to the difference in linear expansion coefficients of the conductors 1 and 2 and the dielectric strip 3 is absorbed. In other words, the linear expansion coefficient of Zn or Al forming the conductors 1 and 2 is 20 to 30 ppm/° C. On the other hand, the linear expansion coefficient of fluorine resin forming the dielectric strip 3 is 100 to 150 ppm/° C. As a result, an expansion amount of the dielectric strip 3 when the temperature is increased becomes larger than the expansion amount of the conductors 1 and 2. In the conventional construction, stress from the conductors 1 and 2 concentrates in the dielectric strip 3, and the dielectric strip 3 is deformed. On the other hand, in the construction of the present invention, the expansion of the dielectric strip 3 is absorbed by the gap part. Therefore, the stress concentration hardly occurs. As a result, the change in electric characteristic involved in the deformation of the dielectric strip 3 can be suppressed.

When ceramics are used as the dielectric strip 3, the linear expansion coefficient is around 10 ppm/° C., which is smaller than the linear expansion coefficient of Zn and Al. Thus, the shrinking amount of the conductors 1 and 2 when the temperature is decreased is larger than the shrinking amount of the dielectric strip 3. In the conventional construction, the stress concentrates on the dielectric strip 3 when the temperature is decreased, and cracking or chipping may occur in the ceramic material of dielectric strip 3. On the other hand, in the construction of the present invention, the concentration of the stress is moderated. As a result, the cracking or chipping of the dielectric strip 3 can be prevented.

The conductors 1 and 2 may be produced not only by the die-cast molding but also by casting. Alternatively, the conductors 1 and 2 may be produced by forming a primary body by resin molding, and a metal film may be plated on the surface.

The dielectric strip 3 used in the frequency band may be not only fluorine resin but also other dielectric materials having a different specific dielectric constant, such as ceramics, can be used. The groove depth g and the groove width b may be changed in accordance with the specific dielectric constant.

Figure 2:
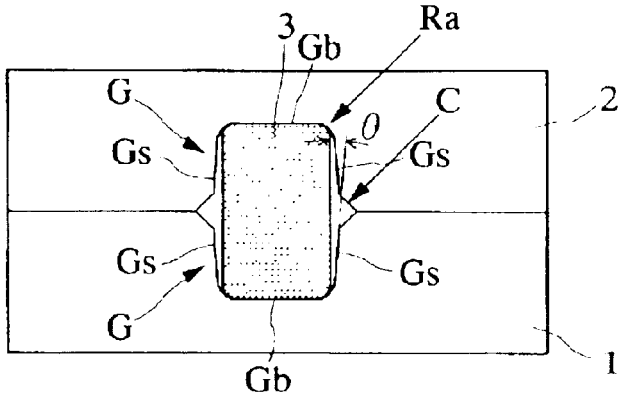
FIG. 2 is a section diagram of a main part of a dielectric line according to a second embodiment.

A construction of a dielectric line according to a second embodiment is shown in FIG. 2. Like FIG. 1, FIG. 2 is a section diagram in a plane perpendicular to a direction of signal transmission. In this example, opening edges C of the grooves G of the conductors 1 and 2 have a cross-sectional chamfered form, which is so-called "C-processed". The constructions of the other parts are the same as those in FIG. 1 and like reference numerals represent like elements. Under the same condition as descried above, the cut-off width of the C-part is 0.21 [mm].

Thus, the forming die does not have contact with the edge when a conductor is manufactured by the die-cast molding. Therefore, the lifetime of the die can be extended. The current concentration to the edge part of the groove opening edge of the two conductors can be reduced, which can also suppress the transmission loss.

Figure 3A:
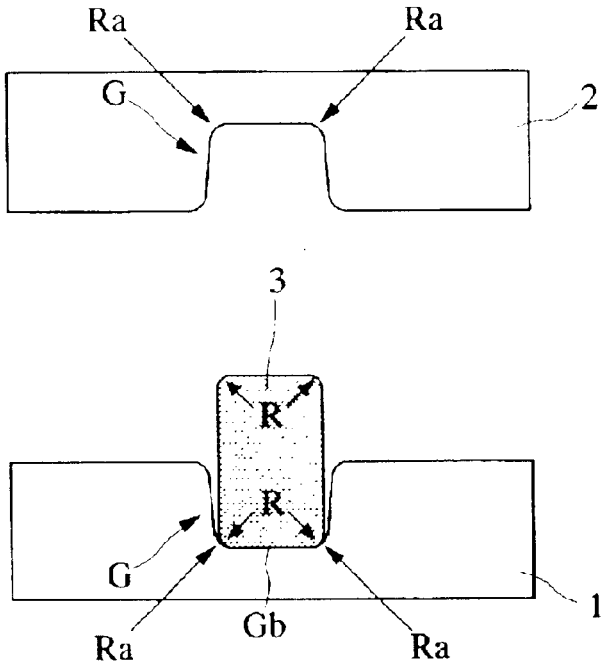
FIGS. 3A and 3B are exploded section diagrams of a main part of a dielectric line according to a third embodiment.

Next, a construction of a dielectric line according to a third embodiment will be described with reference to FIGS. 3A and 3B. In this example, the upper and lower conductors 1 and 2 are separated. In this example, the corner part R (See FIG. 3M of the dielectric strip 3 is formed in a cross-sectional radius form, which is so-called R-processed. On the other hand, the corner parts Ra of the grooves G of the conductors 1 and 2 also have a cross-sectional radius form. Therefore, round parts have contact with each other so that the dielectric strip 3 and the groove bottom surface Gb of the dielectric strip 3 can be abutted in a stable manner. In other words, the groove bottom surface Gb and the upper and lower surfaces of the dielectric strip 3 have contact so that no unnecessary gaps can occur.

Figure 3B:
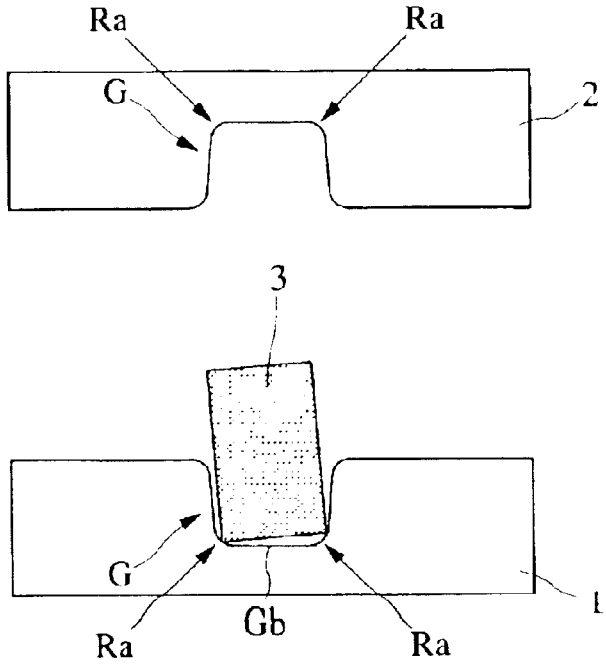

On the other hand, as shown in FIG. 3B, which is a comparative example, when the corner of the dielectric strip 3 is not rounded, a gap occurs between the groove bottom surface Gb and the upper and lower surfaces of the dielectric strip 3 due to even a slight displacement with respect to the groove G. As a result, the dielectric strip 3 is assembled in a gap between two facing grooves in an unstable manner.

When the corner of the dielectric strip 3 has a cross-sectional radius form, the dielectric strip 3 may be inserted between the grooves G of the conductors 1 and 2 easily, which improves the assembly characteristic. The tolerance of the width dimension of the dielectric strip 3 may affect the insertion of the dielectric strip 3 into the grooves G of the conductors 1 and 2 and a wobble of the dielectric strip 3 within the grooves G, but the sensitivity can be alleviated. In addition, the round corner R of the dielectric strip 3 can be formed easily by molding a resin material. Therefore, the increase in costs for the R-processing does not occur.

In the above-described embodiments, the upper and lower conductors 1 and 2 are symmetric with respect to a plane. Therefore, the symmetry of stress on a gap formed by facing grooves can be kept when the two conductors 1 and 2 have contact with each other. Thus, an entirely stable rigid construction can be obtained.

Figure 4:
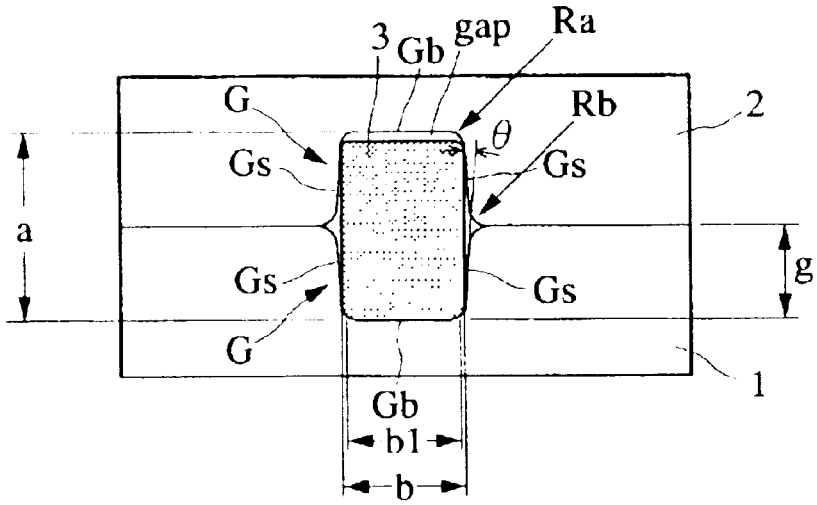
FIG. 4 is a section diagram of a main part of a dielectric line according to a fourth embodiment.

Next, a construction of a dielectric line according to a fourth embodiment is shown in FIG. 4. Like FIG. 1, FIG. 4 is a sectional diagram perpendicular to the direction of the signal transmission. In this example, a gap is provided between the bottom surface of the groove G of the conductor 2 and the facing surface of the dielectric strip 3. The constructions of the other parts are the same as those shown in FIG. 1 and like reference numerals represent like elements.

When the dielectric strip 3 is made of a highly flexible material such as fluorine resin, a gap is not needed between the dielectric strip 3 and the groove bottom surface Gb in particular. In other words, the deformation of the dielectric strip 3 can relieve vertical (a direction between two groove bottom surfaces) pressure caused by expansion and shrinking of the conductors 1 and 2 and the dielectric strip 3 due to temperature changes horizontally. However, when the dielectric strip 3 is made of a less flexible material, such as dielectric ceramics, the deformation of the dielectric strip 3 cannot relieve the pressure. As a result, cracking or chipping might occur in the dielectric strip 3, which might also change the characteristic of the dielectric line. In this case, as shown in FIG. 4, a gap is provided between the groove bottom surface of the conductor 2 and the facing surface of the dielectric strip 3 so as to obtain a structure which can relieve the pressure vertically.

When the dielectric strip 3 is made of fluorine resin, a gap may occur between the bottom surface of the groove of the conductor 2 and the facing surface of the dielectric strip 3. In other words, the gap does not occur when the dielectric strip 3 of fluorine resin and the two conductors 1 and 2 are assembled. However, the dielectric strip 3 expands when heated and then shrinks when cooled in the heating step before use. As a result, the gap might occur between the groove bottom surface of the conductor 2 and the facing surface of the dielectric strip 3 at the time of the shipment. The gap caused in this way can suppress the deformation of the dielectric strip 3 due to the temperature change, and characteristic changes can be avoided.

Specific dimensions of components of the dielectric line with the structure as shown in FIG. 4 are as follows:

When the dielectric strip 3 is made of dielectric ceramics. the difference in linear expansion coefficient from that of the conductors (metal) is assumed as −20 ppm/° C. In this case, the height a of the dielectric strip at room temperature of 25° C. is 1.79 [mm]. When the dielectric strip 3 is made of fluorine resin, the difference in linear expansion coefficient from that of the conductor (metal) is assumed as +100 ppm/° C. In this case, the height a of the dielectric strip at room temperature of 25° C. after the heating processing is 1.785 [mm]. The other dimensions are the same as those in the first embodiment.

Figure 5:
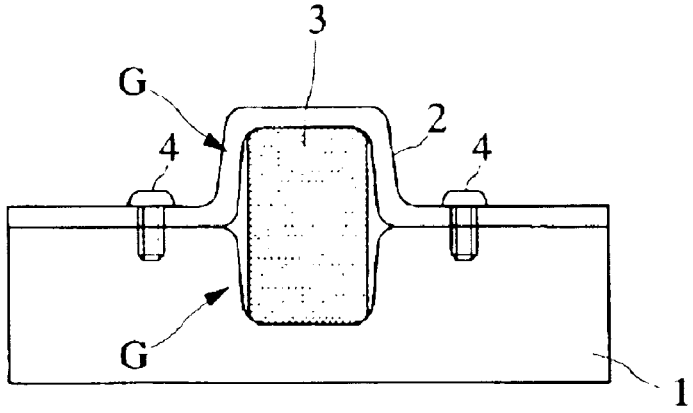
FIG. 5 is a section diagram of a main part of a dielectric line of a fifth embodiment.
Figure 6:
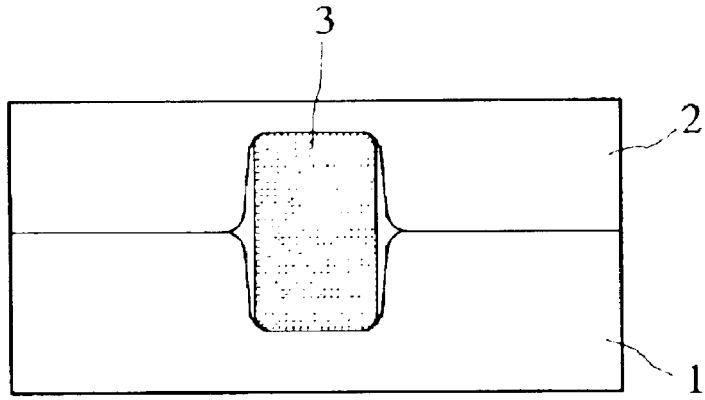
FIG. 6 is a section diagram of a main part of a dielectric line according to a sixth embodiment.
Figure 7:
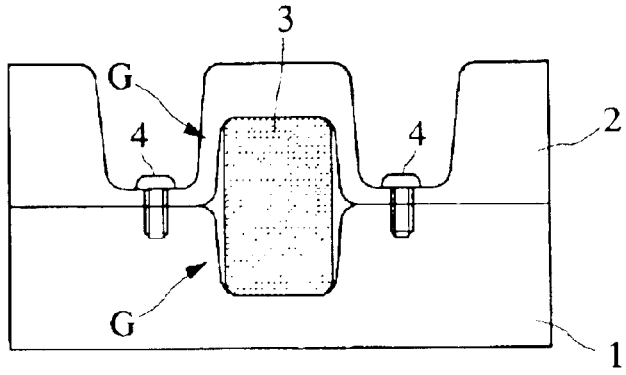
FIG. 7 is a section diagram of a main part of a dielectric line according to a seventh embodiment.

Constructions of dielectric lines according to fifth to seventh embodiments are shown in FIGS. 5 to 7. In these cases, the conductors are provided in a vertically asymmetric form.

FIG. 5 includes conductors 1 and 2. However, the upper conductor 2 is made of a deep-drawing metal plate, which is thinner than the lower conductor 1. The structure of the conductor 1 is the same as that of the conductor 1 shown in FIG. 1. For example, an A1 plate is molded through press-work using a die. A metal film having higher conductivity such as Ag and Au is plated on the surface. The form of the internal surface of the groom formed by deep-drawing is the same as the internal surface of the groove of the conductor 1.

A screw hole is formed in the conductor 1. The dielectric strip 3 is fitted into the groove G of the conductor 1. The conductor 2 is covered over the conductor 1. The conductor 2 is fixed to the conductor 1 by using a fixing screw 4.

With this structure, the elasticity of the dielectric strip 3 is maintained because of the elasticity of the thinner conductor 2 in a space formed by the facing grooves. Therefore, the upper and bottom surfaces of the dielectric strip 3 and the groove bottom surface of the conductors 1 and 2 can touch more tightly. Thus, the variation in electric characteristic can be suppressed, and the transmission loss can be suppressed.

In an example shown in FIG. 6, the bottom conductor 1 is S45G (a carbon steel material for a machine structure provided by JIS G4051). The upper conductor 2 is Al. Both of them are processed by die-cast molding and a metal film having higher conductivity is plated on the surfaces. The form of the internal surfaces surrounding the dielectric strip 3 is the same as those shown in FIG. 1.

In the physical properties, the elasticity of Al is smaller than that of S45C. Thus, when the conductors 1 and 2 are pressed to each other by using a screw, for example, the form of the surface of the conductor 2 follows the form of the surface of the conductor 1. Therefore, both of the conductors 1 and 2 can touch more closely. As a result, no unnecessary gap is formed other than a space formed by the facing grooves. The increase in transmission loss can be suppressed.

In an example shown in FIG. 7, the same materials such as Al are used as the materials of the upper and lower conductors 1 and 2. However, the thickness of a position for fixing the conductor 2 to the conductor 1 is decreased. The fixing screw 4 is fixed at the thinner part. With this structure, the form of the groove G surrounding surface of the conductor 2 follows the surface of the groove G surrounding surface of the conductor 1. Both of them touch with each other more closely. As a result, no unnecessary gaps occur relative to the dielectric strip 3, which can suppress the increase in transmission loss.

Next, constructions of an EHF radar module and EHF radar, which are an eighth embodiment of the high frequency circuit and the high frequency circuit apparatus of the present invention will be described with reference to FIG. 8.

Figure 8:
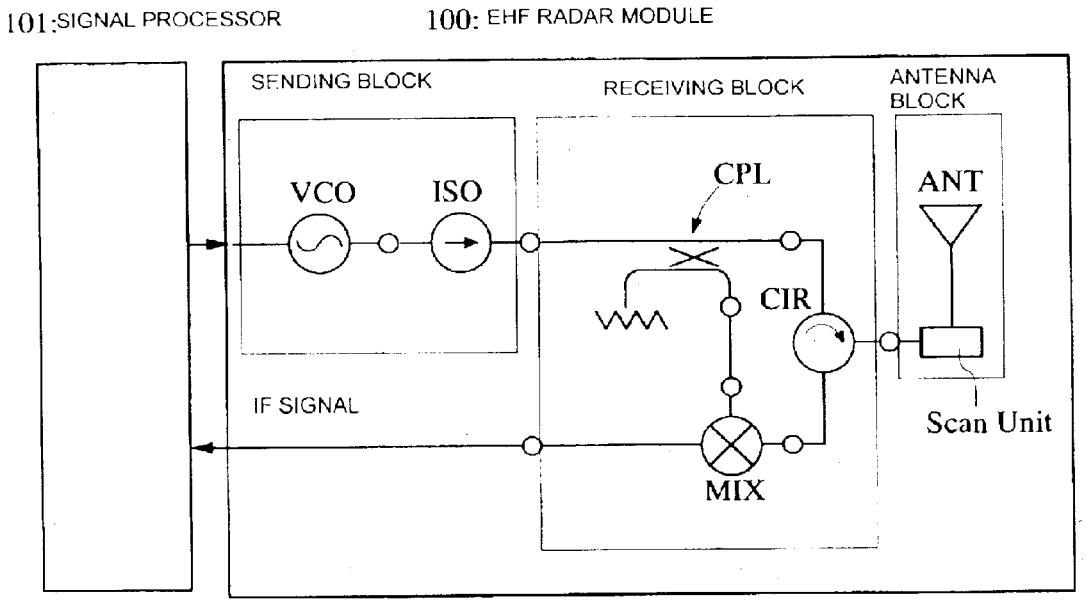
FIG. 8 is a block diagram indicating a construction of an EHF radar module and an EHF radar according to an eighth embodiment.

FIG. 8 includes a voltage control oscillator (VCO) and an isolator (ISO) in a sending block, a coupler (CPL), a circulator (CIR) and a mixer (MIX) in a receiving block, and an antenna (ANT) and a scan unit in an antenna block. The VCO uses a Gunn diode, a varactor diode and so on. The ISO suppresses a reflected signal returning to the VCO. The CPL has an NRD guide for capturing a part of a transmitted signal as a local signal. The CIR supplies a transmitted signal to a primary radiator of the antenna (ANT) and transmits a recieved signal to the mixer (MIX). The MIX generates a harmonic component of the received signal and the local signal and outputs as an IF signal (intermediate frequency).

The above-described components are included in an EHF radar module 100. A signal processing portion 101 detects a relative distance and a relative speed of an object from a modulation signal to the VCO of the EHF radar module 100 and an IF signal from the EHF radar module 100. The EHF radar includes the signal processing portion 101 and the EHF radar module 100.

A dielectric line having one of the above-described structures may be used as the EHF radar module and the transmission path of the EHF radar. Thus, an apparatus can be obtained having lower transmission losses and the higher electric efficiency. In addition, since the reduction of the signal to noise ratio can be suppressed, the detectable distance can be increased.

When the transmission path is used for a communication apparatus, an effect such as the decrease in error rate of data transmission can be obtained.

Although the present invention has been described in relation to particular embodiments thereof, modifications and other uses will become apparent to those skilled in the art. Accordingly, it is preferred that the present invention not be limited by the specific disclosure herein, but only by the appended claims.

What is claimed is:

1. A dielectric line, comprising:

two conductors; and a dielectric strip provided between the two conductors, wherein the two conductors have portions thereof which physically contact each other and thereby define a groove therebetween within which the dielectric strip fits;

a bottom corner of the groove having a cross-sectional radius form;

a side surface of the groove tapering such that a width of the groove increases as a distance from a bottom surface increases; and a gap provided between the side surface of the groove and a side surface of the dielectric strip.

2. A dielectric strip according to claim 1, wherein a gap is provided between the bottom surface of the groove and a surface of the dielectric strip facing the bottom surface of the groove.

3. A dielectric line according to claim 1 or 2, wherein a top corner of the groove has a cross-sectional radius form or a cross-sectional chamfered form.

4. A dielectric line according to claim 1 or 2, wherein the two conductors are symmetric with respect to a plane.

5. A dielectric line according to claim 1 or 2 wherein a corner of the dielectric strip has a cross-sectional radius form.

6. A dielectric line according to claim 1 or 2 wherein the width of the groove is equal to or less than ½ of a wavelength of an operating frequency band; and twice a value of a depth of the groove is equal to or greater than ½ of the wavelength of the operating frequency band.

7. A dielectric line according to claim 1 or 2, wherein the two conductors have a different rigidity with respect to each other.

8. A dielectric line according to claim 7, wherein the connection portions of the two conductors which are in contact with each other have different thickness from each other.

9. A high frequency circuit comprising a dielectric line according to claim 1 or 2 as a signal transmission line.

10. A high frequency circuit apparatus comprising a high frequency circuit according to claim 9 for processing sent signals or received signals.

* * * * *